US005212863A

United States Patent [19]

Matsumoto

[11] Patent Number: 5,212,863

[45] Date of Patent: May 25, 1993

[54] METHOD FOR FORMING ELEMENT-FREE SPACES IN SLIDE FASTENER CHAIN

[75] Inventor: Masao Matsumoto, Toyama, Japan

[73] Assignee: Yoshida Kogyo K. K., Tokyo, Japan

[21] Appl. No.: 871,728

[22] Filed: Apr. 21, 1992

[30] Foreign Application Priority Data

May 13, 1991 [JP] Japan ..... 3-202618[U]

[51] Int. Cl.[5] ..... B21D 53/50

[52] U.S. Cl. ..... 29/408; 29/426.5; 29/770; 83/921

[58] Field of Search ..... 29/408, 410, 426.5, 29/33.2, 770; 83/921

[56] References Cited

U.S. PATENT DOCUMENTS 3,225,430 12/1965 Fasciano ..... 29/408
4,307,499 12/1981 Isella ..... 29/408
4,573,383 3/1986 Matsumoto ..... 29/408

FOREIGN PATENT DOCUMENTS 0021286 1/1981 European Pat. Off. .
0488816 6/1992 European Pat. Off. .
2207664 6/1974 France .

*Primary Examiner*—P. W. Echols
*Attorney, Agent, or Firm*—Hill, Steadman & Simpson

[57] ABSTRACT

A method for forming element-free space sections in a slide fastener chain is provided that coupling elements can be efficiently removed by a small force without damaging fastener tapes.

The method for forming element-free space sections in the slide fastener chain comprises the steps of:

cutting heads of interengaged discrete coupling elements of space-forming sections of one leg of forked legs of the individual coupling element, pushing up the heads of the coupling elements in the direction orthogonal to the fastener tape faces from the cutting side, and gripping the remaining cut legs by grippers to be drawn-out and removed in the direction orthogonal to the fastener tape faces.

3 Claims, 6 Drawing Sheets

METHOD FOR FORMING ELEMENT-FREE SPACES IN SLIDE FASTENER CHAIN

BACKGROUND OF THE INVENTION

1. Field of the Invention

This invention relates to removing coupling elements of a synthetic resin to form element-free space resistors in a slide fastener chain including a pair of rows of interengaged discrete coupling elements mounted on confronting edges of a pair of fastener tapes.

2. Prior Art

One conventional method of forming element-free space sections in a slide fastener chain provided with synthetic resin coupling elements is disclosed, for example, in UP, U no. 55-109410 (Japanese unexamined utility Model Publication). This method for forming space sections free of coupling elements in a slide fastener chain includes the steps of: putting the slide fastener chain on a die provided with a through hole of the element width at the center position; actuating a punch provided with two steps on side faces thereof to descend from an upward position toward the coupling elements to punch the heads; and continuing the descent of the punch to catch and remove legs that remain in the fastener tape by the punch step.

However, the above-mentioned element-free space section forming method suffers from several drawbacks. For example, sine the punch descends to punch the heads of the coupling elements, and continues its descent to catch and remove the remaining cut legs by the punching process, the stringer cores of the fastener tape are susceptible to damage. Descent of the punch sometimes results in chain breakage. Furthermore, a large force is required in order to punch and remove legs in one operation.

SUMMARY OF THE INVENTION

It is therefore an object of this invention to overcome the aforementioned disadvantages of known methods, and to provide a method of forming element-free space sections in a slide fastener chain, whereby coupling elements can be efficiently removed by a small force without damaging fastener tapes.

In an embodiment of this invention, there is provided a method for forming element-free space sections in a slide fastener chain including the steps of: cutting heads of interengaged discrete coupling elements at space sections of the slide fastener chain provided with coupling elements by use of a punch and cutters to separate each head from one leg of forked legs of the individual coupling element; pushing up the heads of the coupling elements from the cutting side in a direction orthogonal to fastener tape faces by a knock-out rod to remove the other leg and the heads of the coupling elements from the fastener tapes; and gripping the cut legs remaining on the fastener tapes with gripers to draw-out and remove the cut legs in a direction orthogonal to the fastener tape faces.

In another embodiment of this invention, in removing cut legs remaining on fastener tapes, there is provided another method for forming element-free space sections on a slide fastener chain including the steps of: gripping only the cut legs at opposite ends of space sections with grippers to draw-out and remove the cut legs of the opposite ends in a direction orthogonal to the fastener tape faces; and scraping off the remaining cut legs by means of a rotary cutter and a rotary tumbler for leading the space sections toward the rotary cutter to remove the cut legs from the fastener tapes.

With the present invention, the heads of the cut legs of the coupling elements are removed in respective steps. The heads and the cut legs of the coupling elements are moved from the chain in the direction reverse to the direction in which they were applied, e.g. by permeating a molten coupling element into the fastener tapes. Therefore, in this method, the heads of the cut legs of the coupling elements can be easily removed with relatively little force without damaging the fastener tapes, and without causing the chain to break, thus forming element-free space sections efficiently.

In removing the cut legs, (the cut legs being one of principal parts) by means of a rotary cutter and a rotary tumbler after the cut legs are removed from opposite ends of the space sections, the cut legs can be efficiently removed without requirement of fine adjustment of the rotary cutter and the rotary tumbler and without damaging the remaining coupling elements.

These and other objects and advantages of this invention will be more apparent from the following detailed description of a preferred embodiment taken in conjunction with the accompanying drawings, in which like reference numbers refer to like or corresponding parts through the several views.

DETAILED DESCRIPTION OF THE PREFERRED EMBODIMENT

Figure 1:
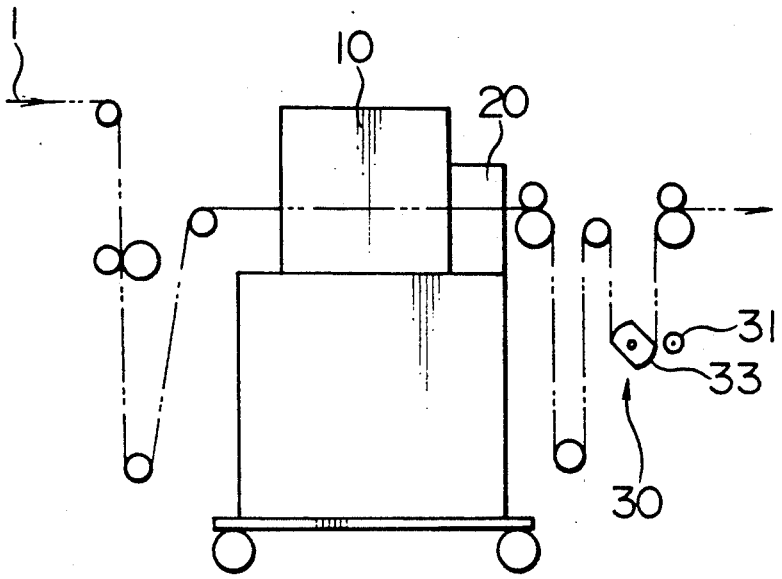
FIG. 1 is a schematic view illustrating an apparatus for carrying out a method of this invention.

An embodiment of this invention will be described with reference to the drawing figures.

Referring now to FIG. 1, there is shown an apparatus for carrying out a space section forming method of the present invention including a coupling element punching mechanism 10, a first coupling element leg removing mechanism 20, and a second coupling element leg removing mechanism 30.

Figure 2:
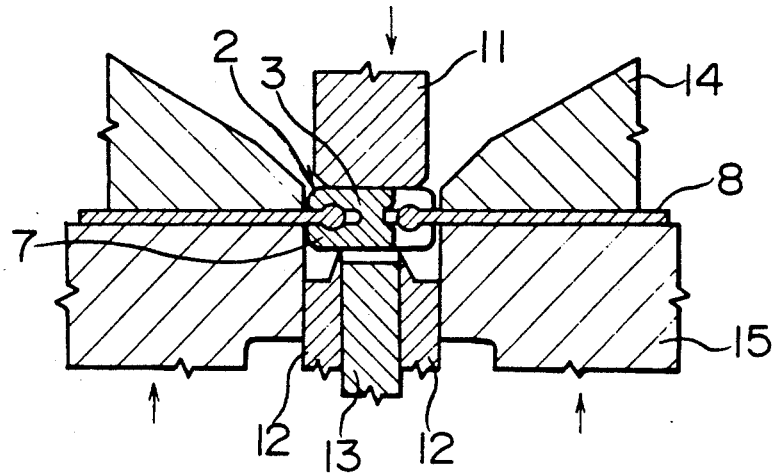
FIG. 2 is a sectional view illustrating a slide fastener chain set in the apparatus of FIG. 1, in preparation for punching heads of coupling elements.

Right and left fastener stringers are supplied in an interengaged state to remove heads 3 of interengaged coupling elements 2 in the coupling punching mechanism 10 as shown in FIG. 2.

Figure 3:
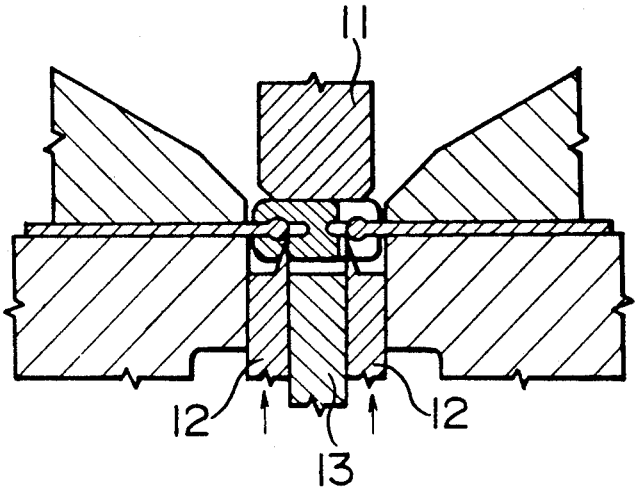
FIG. 3 is a sectional view illustrating the point at which legs of coupling elements are cut.
Figure 4:
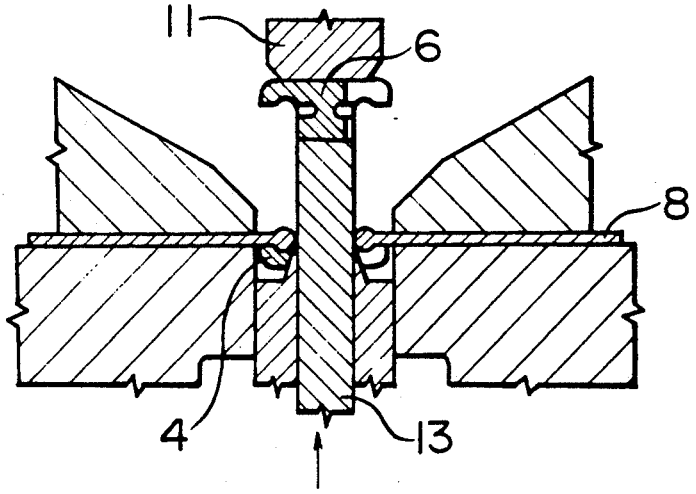
FIG. 4 is a sectional view illustrating the point at which cut heads of coupling elements are removed.
Figure 8:
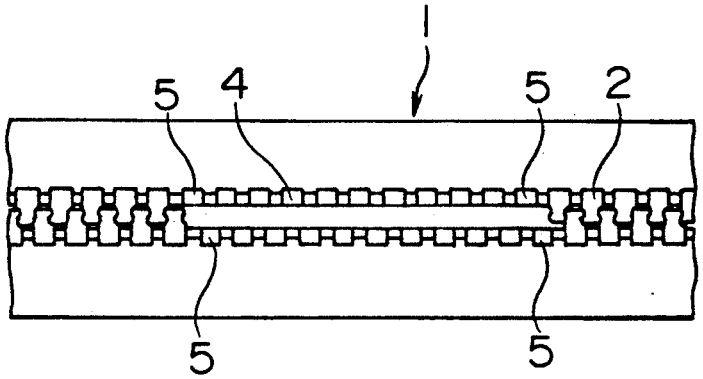
FIG. 8 is a plan view illustrating a slide fastener chain in which heads of coupling elements are removed.
Figure 9:
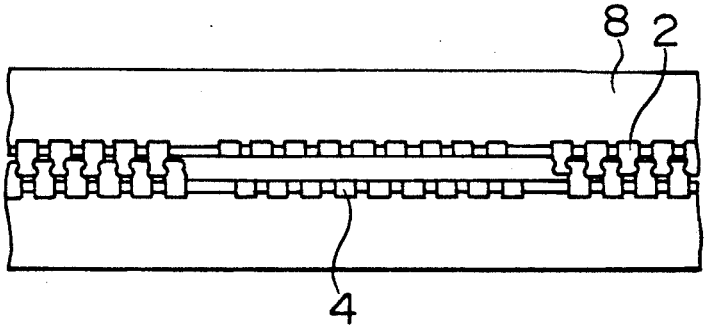
FIG. 9 is a plan view illustrating a slide fastener chain in which cut legs are removed from opposite ends of space-forming sections.

Referring to FIG. 2 to FIG. 4 showing the orders for removing heads 3 of coupling elements 2 from fastener tapes 8, a slide fastener chain 1 is guided by a pair of right and left chain guides 14. When predetermined sections 9 of the slide fastener chain 1 (overlying apertures in the chain guides 14) reach the coupling element punching mechanism 10, the transfer of the fastener chain is stopped. Pressure pads 15, 15 are actuated to ascend into the apertures of chain guides 14. Then, the predetermined sections 9 of fastener tapes 8 are held between the chain guides 14. The heads 3 of the coupling elements 2 are pressed by means of a descending punch 11 and a pair of ascending cutters 12, 12 to cut lower forked legs 7 of the coupling elements 2 as shown in FIG. 3. Next, the cut head 6 of the individual coupling element 2 is held between the punch 11 and a knock-out rod 13 and caused to ascend to remove the heads 3 and the upper legs of the coupling elements. The knock-out rod 13 has the same length as the section 9, and is disposed between the cutters 12. The knock-out rod 13, together with the cutters 12, is ascended to remove and discharge the heads 6 toward the outside as shown in FIG. 4. The slide fastener chain 1 is transferred into the first coupling element leg removing mechanism 20 while the cut legs remain in stringer cores 8 as shown in FIG. 8.

Figure 5:
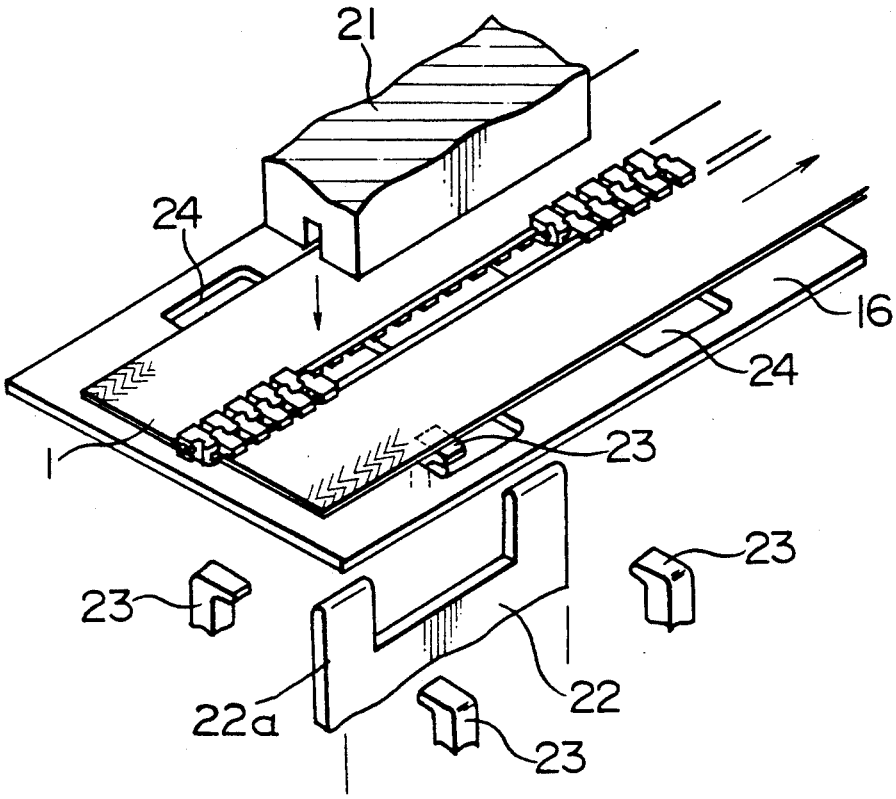
FIG. 5 is a schematic perspective view illustrating a first coupling element leg removing mechanism for removing cut legs at opposite ends.
Figure 6:
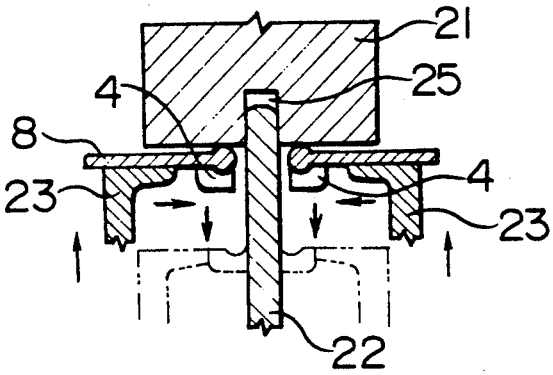
FIG. 6 is a sectional view illustrating principal parts of the first coupling element leg removing mechanism illustrated in FIG. 5.

FIG. 5 and FIG. 6 show an apparatus for removing the cut legs 5 disposed at opposite ends of the section 9 in the first coupling element leg removing mechanism 20. The slide fastener chain 1 is transferred via a chain guide 16 from the coupling element punching mechanism 10. When the slide fastener chain 1 reaches the first coupling element leg removing mechanism 20, it is stopped, and a space section determining member 21 descends from an upward position to carry out the positioning of the slide fastener chain 1, as shown in FIG. 5. The chain guide 16 is disposed contacting the back face of the slide fastener chain 1, and is provided with a pair of working apertures 24, 24 at the position corresponding to the opposite ends of the section 9. A center guide 22 is set under the chain guide 16 and is ascended through the working apertures 24 as shown in FIG. 5 and FIG. 6. Projections 22*a* at opposite ends of the center guide 22 are passed through the punched gaps of the heads 3 of the coupling elements in the slide fastener chain 1 and engaged in a positioning groove 25 which is formed in the back face of the space section determining member 21, so as to position the guide 22 with respect to the member 21. Right and left grippers 23, 23 are disposed at opposite ends of the center guide 22, and ascended as shown by arrows in FIG. 6. After the grippers contact the back faces of the fastener tape 8, they are caused to move toward each other to hold cut legs 5 at opposite ends of the section 9 between the side of the center guide 22 an the grippers 23, 23. The cut legs 5 are drawn-out downwardly in a direction orthogonal to the surfaces of the slide fastener tapes 8 as shown in phantom line in FIG. 6, while holding the cut legs 5 between the center guide 22 and the grippers 23.

Figure 7:
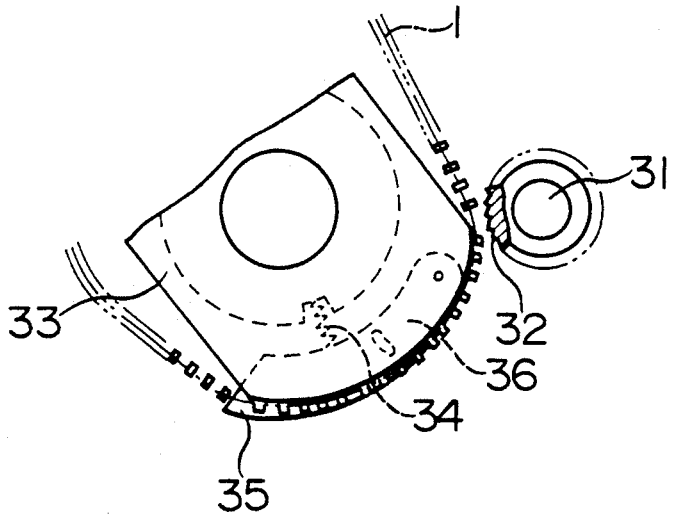
FIG. 7 is a side view illustrating principal parts of a second coupling element leg removing mechanism.

The slide fastener chain 1 in which the cut legs 5 are removed at opposite ends of the section 9 is transferred to the second coupling leg element removing mechanism 30 by guide rollers. The second removing mechanism 30 serves to scrape off and remove all of remaining cut leg 4 by means of a rotary cutter 31 and a rotary tumbler 33 as shown in FIG. 1 and FIG. 7.

Figure 10:
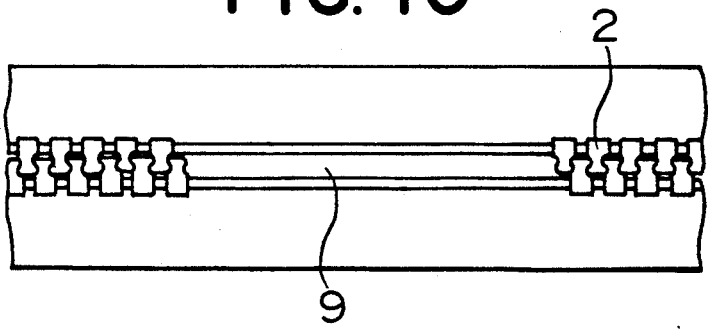
FIG. 10 is a plan view illustrating a slide fastener chain in which space sections are formed and completed.

The rotary tumbler 33 has a conventional elliptic shape and is provided with an arcuate section terminal detector 36 for which is always urged outwardly by a spring 34. The slide fastener chain 1, which has been processed in the first coupling element removing mechanism 20, is always moved and guided along the space section terminal detector 36. When the head-removed portion of the section 9 reaches the detector, the section terminal detector 36 is projected to the section by the spring 34 as shown in FIG. 7, so that a tip stopper 36 contacts the heads of the coupling elements 4 in the section 9. Then, a notch (not shown) for preventing the rotation of the rotary tumbler 33 by a pulling force of the slide fastener chain 1 is released to rotate the rotary tumbler 34, so that the slide fastener chain 1 approaches the rotary cutter 31. The remaining cut legs 4 are scraped off and removed by the blades 32 of the rotary cutter 31 as shown in FIG. 10. Since the cut legs 5 at the opposite ends of the section 9 have already been removed from the slide fastener chain 1, the remaining cut legs 4 are easily removed without requirement of fine adjustment and without damaging the coupling elements 2 arranged adjacent to the space section.

Figure 11:
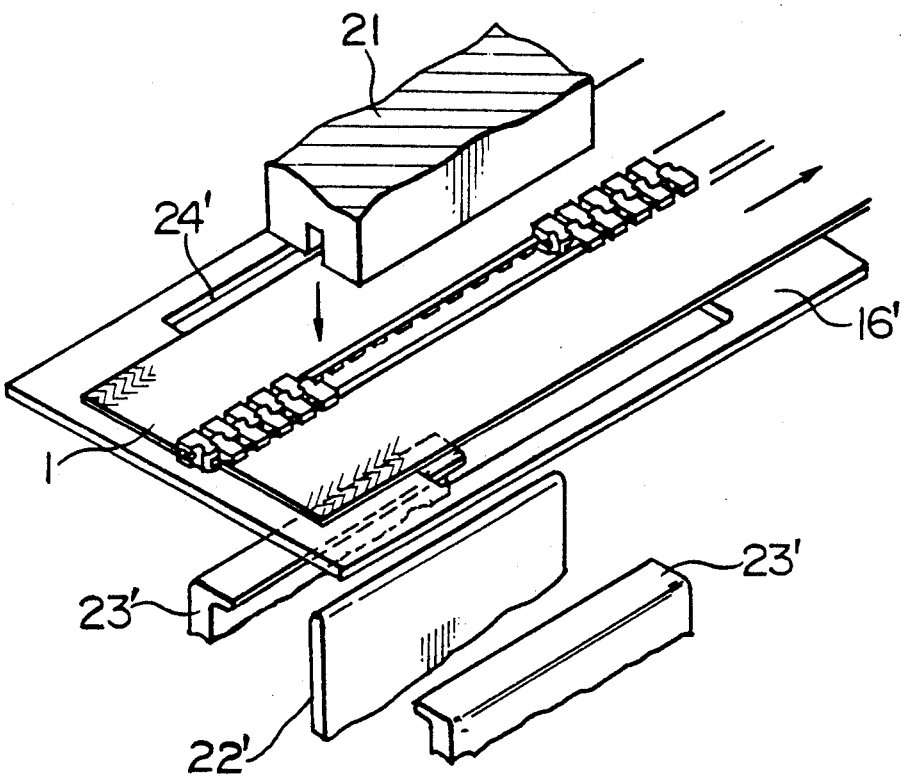
FIG. 11 is a schematic perspective view illustrating a coupling leg element removing mechanism for removing all cut legs simultaneously.

Another embodiment of the present invention is shown in FIG. 11. This embodiment uses a coupling leg element removal mechanism similar to that illustrated in FIG. 5, but removes all of the cut legs within the section 9 simultaneously, thus eliminating the need for a section removing mechanism.

As described, according to this invention, the heads and the cut legs of the coupling elements are respectively removed in the different processes, so that the coupling elements can be efficiently and naturally removed from the fastener tapes without damaging the fastener tapes.

In the coupling leg element removing mechanism 20', all cut legs adhered to the fastener taps are removed at one time from the section 9. Similar to the process illustrated in FIG. 6, all the cut legs are held between a flat plate 22' of center guide 22 and grippers 23' having approximately the same length as the section 9 and thereby are drawn-out downwardly. The working apertures 24' of the chain guides 16' are approximately the same length as the section 9.

What is claimed is:

1. A method for forming element-free space sections in a slide fastener chain including a pair of rows of interengaged discrete coupling elements mounted on confronting edges of a pair of fastener tapes, said method comprising the steps of:

cutting legs of interengaged discrete coupling elements at predetermined sections of said slide fastener chain provided with coupling elements by use of a punch and cutters to separate each head from one leg of forked legs of the individual coupling elements;

pushing up said heads of said coupling elements from the cutting side in the direction orthogonal to fastener tape faces by a knock-out rod to remove the other leg and said heads of said coupling elements from said fastener tapes; and gripping at least some of the cut legs remaining on fastener tapes by grippers to draw-out and remove at least some cut legs in the direction orthogonal to said fastener tape faces.

2. A method according to claim 1, wherein said at least some cut legs remaining in said fastener tape comprise all of said cut legs in said section.

3. A method according to claim 1, wherein said step of gripping at least some of said cut legs comprises:

gripping only said cut legs at opposite ends of said predetermined sections by said grippers to draw-out and remove said cut legs at opposite ends in a direction orthogonal to said fastener tape faces, and said method further comprises the step of, scraping off cut legs remaining in said section, after removing said cut legs at opposite ends, by means of a rotary cutter and a rotary tumbler for leading said section toward said rotary cutter to remove said cut legs remaining in said section from said fastener tapes.

* * * * *